US010266358B2

(12) United States Patent
Widsten et al.

(10) Patent No.: US 10,266,358 B2
(45) Date of Patent: Apr. 23, 2019

(54) EJECTING DAMAGED/DEFORMED MEDIA

(71) Applicant: NCR Corporation, Duluth, GA (US)

(72) Inventors: Benjamin T. Widsten, Kitchener (CA); Sandeep Singh Gill, Kitchener (CA); Jason Michael Gillier, Waterloo (CA)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/813,748

(22) Filed: Nov. 15, 2017

(65) Prior Publication Data

US 2018/0072524 A1 Mar. 15, 2018

Related U.S. Application Data

(62) Division of application No. 15/198,329, filed on Jun. 30, 2016, now Pat. No. 9,969,583.

(51) Int. Cl.

| | |
|---|---|
| ***B65H 9/16*** | (2006.01) |
| ***B65H 5/06*** | (2006.01) |
| ***B65H 7/00*** | (2006.01) |
| ***B65H 9/00*** | (2006.01) |
| ***B65H 9/20*** | (2006.01) |

(52) U.S. Cl.

CPC ..... *B65H 9/16* (2013.01); *B65H 5/062* (2013.01); *B65H 7/00* (2013.01); *B65H 9/002* (2013.01); *B65H 9/163* (2013.01); *B65H 9/166* (2013.01); *B65H 9/20* (2013.01); *B65H 2511/528* (2013.01); *B65H 2513/53* (2013.01); *B65H 2601/11* (2013.01); *B65H 2701/1912* (2013.01)

(58) Field of Classification Search

CPC ..... B65H 9/16; B65H 9/002; B65H 9/163; B65H 9/166; B65H 9/20; B65H 5/062; B65H 7/00; B65H 2701/1912

See application file for complete search history.

(56) References Cited

U.S. PATENT DOCUMENTS

| | | | | |
|---|---|---|---|---|
| 6,168,153 | B1 * | 1/2001 | Richards | B65H 5/062 271/226 |
| 2002/0079636 | A1 * | 6/2002 | Riccardi | B65H 5/021 271/3.15 |
| 2003/0057637 | A1 * | 3/2003 | Kawamura | B65H 9/002 271/227 |
| 2011/0042887 | A1 * | 2/2011 | Kallin | B65H 9/166 271/227 |
| 2014/0191465 | A1 * | 7/2014 | Machamer | B65H 5/068 271/254 |
| 2016/0055700 | A1 * | 2/2016 | Wang | G07F 19/202 271/314 |
| 2016/0282784 | A1 * | 9/2016 | Tanaka | G03G 15/6529 |
| 2016/0297636 | A1 * | 10/2016 | Hagihara | B65H 5/062 |
| 2017/0121139 | A1 * | 5/2017 | Gillier | B65H 9/166 |
| 2017/0260016 | A1 * | 9/2017 | Tan | B65H 9/16 |

* cited by examiner

*Primary Examiner* — David H Bollinger

(74) *Attorney, Agent, or Firm* — Schwegman, Lundberg & Woessner

(57) ABSTRACT

A deskew module of a valuable media depository is selectively controlled ejection processing. Upon detection of a jammed item of media within the deskew module, angled drives are activated to lift a jammed corner of the item off a track base of the deskew module and free the item's jammed corner. Next, straight drives are activated to eject the item from the deskew module.

4 Claims, 9 Drawing Sheets

EJECTING DAMAGED/DEFORMED MEDIA

BACKGROUND

Currency recyclers and depositories (types of media handing devices) generally include note separators to separate stacks of notes before being processed by a deskew module that deskews each note for further downstream processing, such as imaging. These conventional deskew modules attempt to ensure that a leading edge of the media makes first contact with the deskew track base.

The main purpose of the deskew module in media handling devices is to align the document evenly against the deskew track base so the document is parallel to the track base. The document is aligned evenly against the track base. Sometimes, a document crumples, folds in some manner and is damaged/deformed when it is driven against the track base and becomes jammed.

The jammed damaged/deformed document is then attempted to be ejected back to the user. Since the document is jammed firmly against the deskew track base, moving it backward (or forward) can cause further damage/deformation to the document as it drags against the deskew track base. The further damaged/deformed document may jam worse during the subsequent attempts by the deskew module resulting in a fatal fault require a manual service call to the media handling device.

SUMMARY

In various embodiments, methods and a valuable media depository for ejecting damaged/deformed media within a deskew module are provided.

According to an embodiment, a method for ejecting damaged/deformed media is presented. Specifically, in one embodiment, angled drives within a deskew module are activated in response to a jammed item of media situated within the deskew module. Next, the angled drives are deactivated and straight drives are activated within the deskew module to eject the item from the deskew module.

DETAILED DESCRIPTION

Figure 1A:
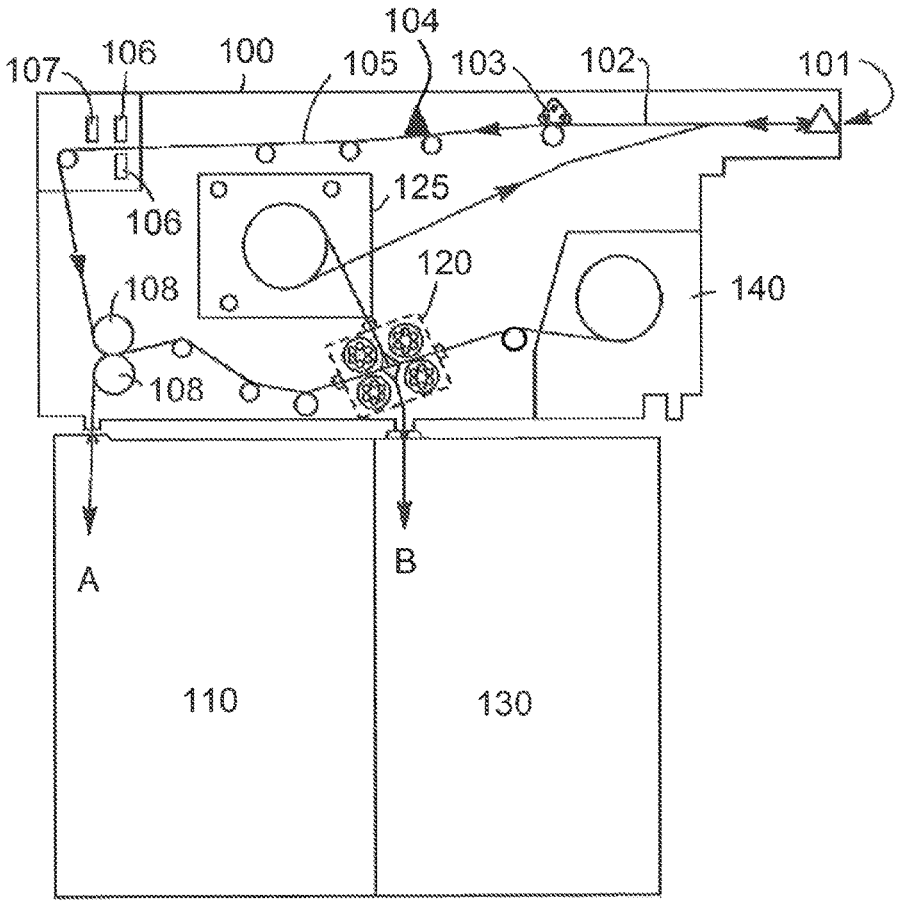
FIG. 1A is a diagram depicting a deposit module of a Self-Service Terminal having a deskew module, according to an example embodiment.

FIG. 1A is a diagram depicting a one-sided view of a valuable media depository 100, according to an example embodiment (also referred to as a deposit module). It is to be noted that the valuable media depository is shown with only those components relevant to understanding what has been added and modified to a conventional depository for purposes of providing deskewing of limp media fed into the depository 100.

The depository 100 is suitable for use within an Automated Teller Machine (ATM), which can be utilized to process deposited banknotes and checks (valuable media as a mixed bunch if desired). The deposit module 100 has an access mouth 101 (media or document infeed) through which incoming checks and/or banknotes are deposited or outgoing checks and/or banknotes are dispensed. This mouth 101 is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport path 102 away from the mouth 101 in a substantially horizontal direction from right to left shown in the FIG. 1A. They then pass through a separator 103 and from the separator to a novel deskew module 104 (discussed in detail below with reference to the FIGS. 1B-1F) along another pathway portion 105, which is also substantially horizontal and right to left. The items are now de-skewed and aligned for reading by imaging cameras 106 and a Magnetic Ink Character Recognition (MICR) reader 107.

Items are then directed substantially vertically downwards to a point between two nip rollers 108. These nip rollers cooperate and are rotated in opposite directions with respect to each other to either draw deposited checks and/or banknotes inwards (and urge those checks and/or banknotes towards the right hand side in the FIG. 1A), or during another mode of operation, the rollers can be rotated in an opposite fashion to direct processed checks and/or banknotes downwards in the direction shown by arrow A in the FIG. 1A into a check or banknote bin 110. Incoming checks and/or banknotes, which are moved by the nip rollers 108 towards the right, enter a diverter mechanism 120. The diverter mechanism 120 can either divert the incoming checks and/or banknotes upwards (in the FIG. 1A) into a re-buncher unit 125, or downwards in the direction of arrow B in the FIG. 1A into a cash bin 130, or to the right hand side shown in the FIG. 1A into an escrow 140. Items of media from the escrow 140 can selectively be removed from the drum and re-processed after temporary storage. This results in items of media moving from the escrow 140 towards the left hand side of the FIG, 1A where again they will enter the diverter mechanism 120. The diverter mechanism 120 can be utilized to allow the transported checks and/or banknotes to move substantially unimpeded towards the left hand side and thus the nip rollers 108 or upwards towards the re-buncher 125. Currency notes from the escrow can be directed to the re-buncher 125 or downwards into the banknote bin 130.

As used herein, the phrase "valuable media" refers to media of value, such as currency, coupons, checks, negotiable instruments, value tickets, and the like.

For purposes of the discussions that follow with respect to the FIGS. 1A-1F, "valuable media" is referred to as currency and the "valuable media depository" is referred to as a "depository." Additionally, valuable media may be referred to as a "document" herein.

Moreover, the phrase "damaged/folded media" as used herein refers to any valuable media/document that is jammed and unable to be processed through the deskew module 104 within the depository 100. The reason for the document jam can be for a variety of reasons, such as but not limited to: excessively torn, limp, and/or folded media.

It is also noted that some dimensions and measurements may be implicitly illustrated with the discussions of the FIGS. 1B-1F, these dimensions and measurements may be altered without departing from the novel teachings presented herein for ejecting damaged/folded media within a deskew module 104 integrated within a valuable media depository 100.

Figure 1B:
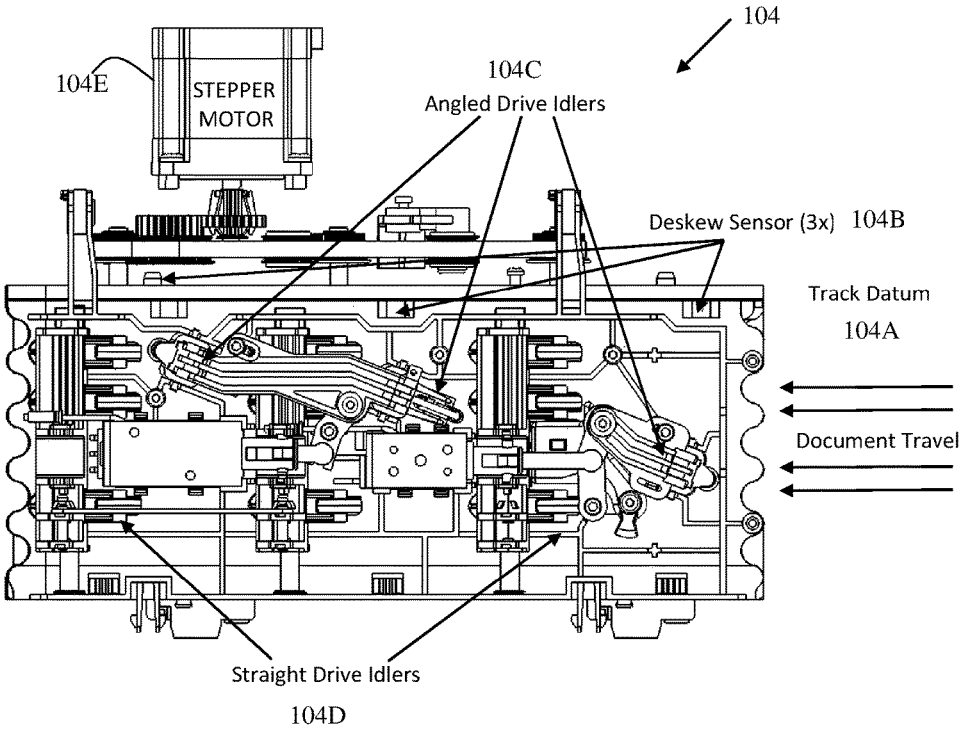
FIG. 1B is a diagram depicting features of a deskew module from a top-bottom perspective, according to an example embodiment.

FIG. 1B is a diagram depicting features of the deskew module 104 for a top-bottom perspective, according to an example embodiment.

Only those components of the deskew module 104 that are necessary for understanding the teachings presented herein are labeled in the FIGS. 1B-1F that follow.

The deskew module 104 includes a track datum 104A representing the starting point of the track associated with the transport path 102 of the valuable media depository 100 that first enters the deskew module 104 and carrying a single currency note (cash, checks, valuable media, document, etc.) as separated by the separator 103. The deskew module 104 also includes a plurality of deskew sensors 1048, a plurality of angled drive idlers 104C, a plurality of straight drive idlers 104D, and a stepper motor 104E that drives the idlers 104C and 104D.

During conventional deskew processing, a conventional deskew module would engage all straight drive idlers upon detection of the media entering on the track datum and then engage all the angled drive idlers at once while disengaging all the straight line idlers. However, with damaged media, the orientation of the damaged media is often off center or skewed upon entering the deskew module, this causes the damage media to twist and turn and as discussed above can result in a media jam within the deskew module. Recent conventional improvements, selectively activate the angled and straight line drives within cells of the deskew module.

However, with both conventional deskew processing and recent advancements, when damaged/folded media becomes jammed within the deskew module, the approach in attempting to eject the media from the deskew module remains the same. That approach is to fire and activate all straight line drives within both cells of the deskew module. This approach usually further damages the media, causes additional drag on the media against the track base, and exacerbates the jam resulting in a fatal fault of the deskew module.

The teachings presented herein provide for a different mode of operation (ejection processing) within the deskew module 104 for damaged/folded media to more optimally resolve and mitigate media jamming conditions within the deskew module 104.

Figure 1C:
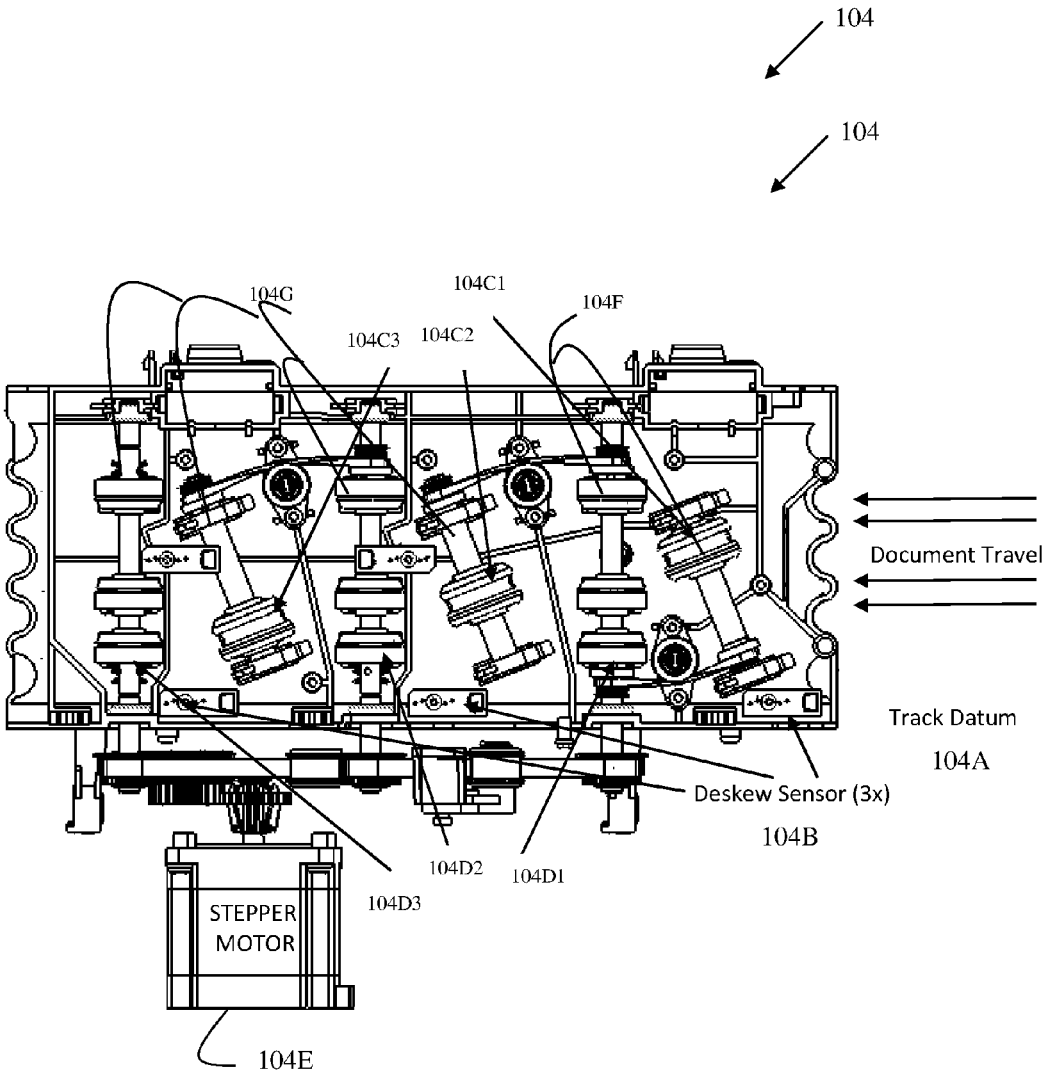
FIG. 1C is a diagram depicting features of a deskew module for a bottom-top perspective, according to an example embodiment.

FIG. 1C is a diagram depicting features of a deskew module 104 for bottom-top perspective, according to an example embodiment.

The deskew module 104 includes a first cell 104F that includes angled drive idlers 104C1 and one straight drive idler 104D1. The second cell 104G includes two angled drive idler 104C2 and 104C3 and two straight drive idlers 104D2 and 104D3. When the straight drive idlers 104D1-D3 are activated the angle drive idlers 104C1-C3 are inactive. However, this activation and deactivation can occur independent within each cell 104F and 104G; so, when cell 104F has angled drive idler 104C1 deactivated, straight drive idler 104D1 is inactive but in cell 104G angled drive idlers 104C2 and 104C3 can be active with straight drive idlers 104D2 and 104D3 inactive (the opposite can be true as well). The cell 104F and 104G is used to illustrate the groupings of the idlers (104F having 104C1 and 104D1 and 104G having 104C2-C3 and 104D2-D3).

A circuit board within the valuable media depository 100 includes component circuitry and firmware programmed to selectively activate and deactivate the idlers 104C1-C3 and 104D1-D3 within the cells 104F and 104G. This is based on readings captured from the deskew sensors 1048 and any optical sensors located throughout the deskew module 104 (and provide timing information as to when those sensors are blocked by media and not blocked by media being processed within the deskew module 104). The firmware and component circuitry may be referred to herein as a deskew controller (or just "controller").

Figure 1D:
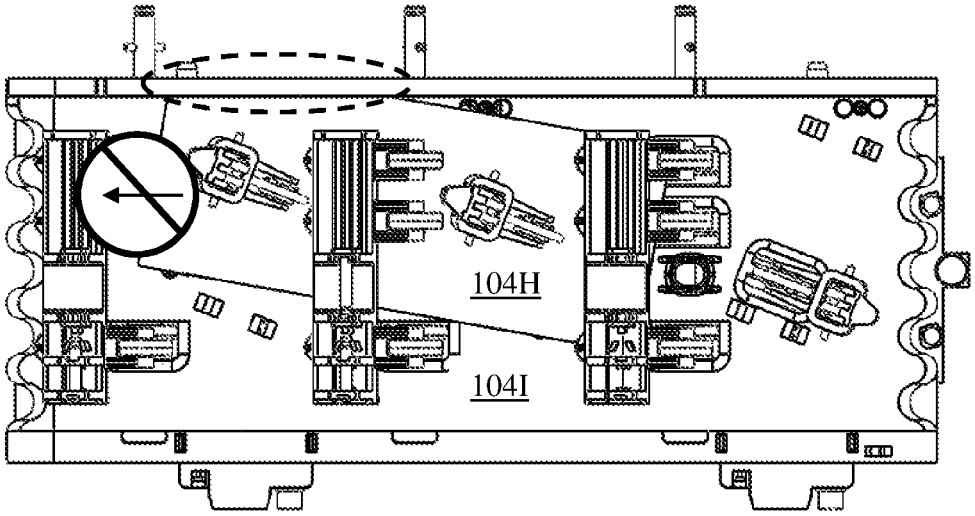
FIG. 1D is a diagram depicting jammed media against the track base of the deskew module, according to an example embodiment.

FIG. 1D is a diagram depicting jammed media 104H against the track base 104I of the deskew module 104, according to an example embodiment.

Figure 1E:
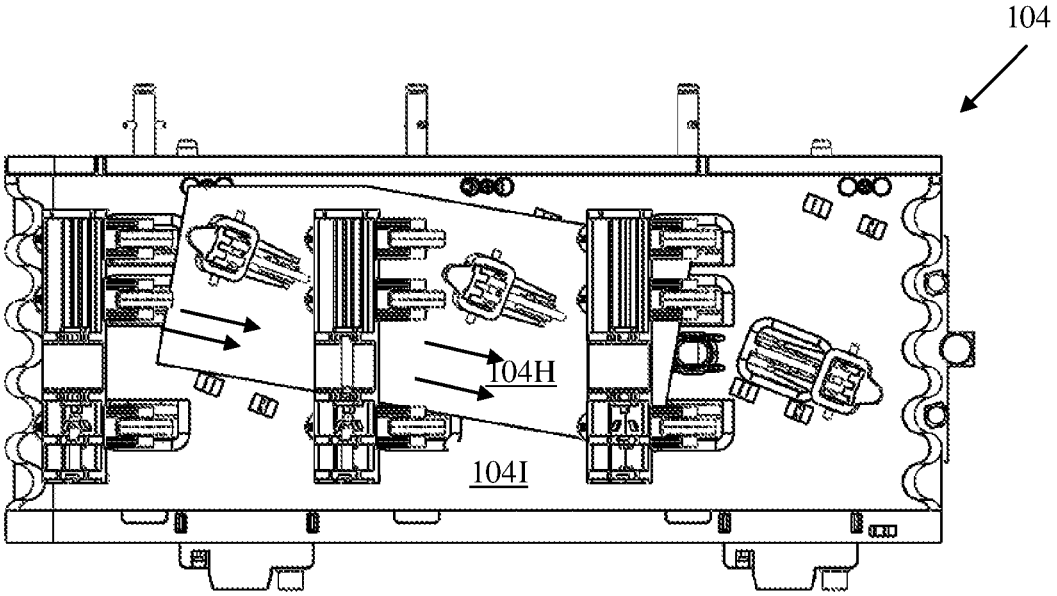
FIG. 1E is a diagram depicting lifting or pulling jammed media off the track base of deskew module to free the jammed media, according to an example embodiment.

FIG. 1E is a diagram depicting lifting or pulling jammed media 104H off the track base 104I of deskew module 104 to free the jammed media 104H, according to an example embodiment.

Figure 1F:
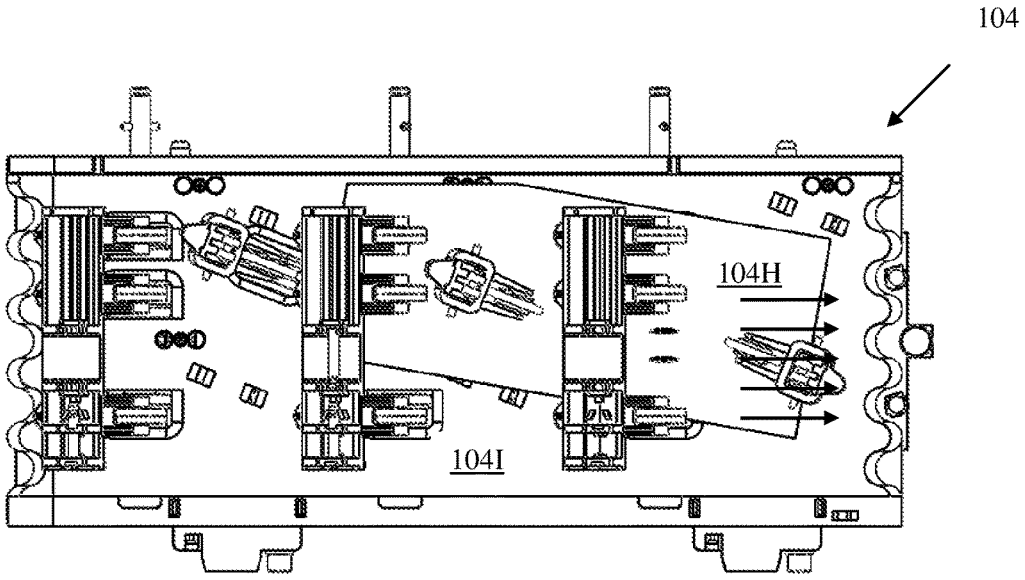
FIG. 1F is a diagram depicting the initial jammed media being ejected from the deskew module, according to an example embodiment.

FIG. 1F is a diagram depicting the initial jammed media 104H being ejected from the deskew module 104, according to an example embodiment.

With the components and arrangements of the deskew module 104 illustrated (necessary for understating the teachings presented herein), FIGS. 1D-1F now illustrate the operation of the deskew module 104 for ejection processing during a jam condition state for the deskew module 104, as those components are controlled by the controller through readings processed by the controller and received from the sensors 1048. The depicted operation in the FIGS. 1D-1F is for ejection mode of operation for the deskew module 104.

The FIGS. 1D-1F illustrate a controller determined and activated ejection mode of operation for the deskew module 104 that is processing/handling a jammed damaged/folded document 104H (document can be used synonymously with media or valuable media herein as previously stated). It is to be noted, the novel deskew module 104 having the novel controller can also operate in other conventional normal modes of operation for deskewing the document 104H.

The FIG. 1D shows a document 104H jammed against a track base 104I the deskew module 104. The document 104H will not move forward within the deskew module 104.

FIG. 1E is a diagram depicting jammed document 104H being lifted up and/or pulled away from the track base 104I to free the jammed document 104H within the deskew module 104, according to an example embodiment.

When the document 104H enters the deskew module 104 (along the track datum 104A,) the controller activates (collectively or by cell (104F and 104G) the idlers (drives) 104C1-C3 and/or 104D1-D3) until the sensors 1048 indicate that the document 104H is fully received and within the deskew module 104. One or a configured number of attempt are made by the controller to deskew the document 104H or move the document 104H through the deskew module onto the pathway 102 to the imagers 106 and/or MICR reader 107. After a configured period of elapsed time or attempts by the controller to unsuccessfully attempt to processing the document 104H, a jam condition is identified by based on the reading from the sensors 1048 indicating that the document 104H is still covering the sensors 1048.

The FIG. 1D illustrates a jam condition where the document's edge is lodged, crumbled, or folded against the track base 104I. The jam does not have to be against an edge of the track base 104I; for instance, the document 104H may have a folded trailing or leading edge or mid body fold that is against the surface of the track base 104I. It is noted that other types of jams for the document 104H can occur (lead edge, etc.) without altering the novel ejection processing discussed herein and below.

The conventional approach when a jam condition is detected is to activate all straight line idlers; this conventional approach is changed by the novel controller presented herein.

As stated before, the conventional ejection processing is to fire all straight line idlers in a reverse direction from the document's original travel direction through the deskew module.

With embodiments herein, the controller, in response to identifying a jam condition for the document 104H, activates all angled drives 104C1-C3 in both cells 104F and 104G in a reverse direction from the document's original travel direction through the deskew module 104 (the result of which is shown in the FIG. 1E). This has the effect of lifting the document's jammed corner off the track base 104I by a slight amount and/or pulling the document's jammed corner away from the track base 104I, which frees the document's jammed corner for a small amount of time (as shown in the FIG. 1E). The controller then activates all straight line drives (idlers) 104D1-D3 in both cells 104F and 104G (when a straight line drive is activated within a cell the corresponding angled drive is automatically deactivated; thus, when the straight line drives are activated in cells 104F and 104G, all the angled drives 104C1-C3 are deactivated), the result of which is shown in the FIG. 1F where the initial jammed document is now freed of a jam and ejected out of the deskew module 104 through activation of the straight drivers 104D1-D3.

In an embodiment and upon detection of a jam condition, the controller activates the angled drives 104C1-C3 for about 50 milliseconds and then activates the straight drives 104D1-D3.

By first activating the angled drives C1 -C3 before activating the straight drives D1-D3, the document 104H is not immediately attempted to be forced out of the deskew module 104H (which may be futile and exacerbate the jam resulting in a fatal fault of the deskew module 104); so, by first activating the angled drives C1-C3 the lodged or crumpled corner of the document 104H is slightly lifted off the track base free the document 104H from its jammed condition, which then permits the straight drives to be activated to eject the document out of the deskew module 104.

The novel mode of ejection processing performed by the controller of the deskew module 104 improves the convention ejection processing by, at least: i) reducing fatal faults for jam conditions within the deskew module 104; ii) reducing service calls to address fatal jam conditions within the deskew module 104; iii) improves the range of media quality that can be processed through the deskew module 104 making the service life of the deskew module 104 longer; iv) improves the range of environmental conditions that can be handled by the deskew module 104 making the service life of the deskew module 104 longer; and v) capable of being implemented within existing deskew module's with firmware upgrades to reflect the novel ejection processing of the controller discussed herein without change mechanical componentry of the existing deskew module.

With the various componentry of a novel deskew module 104 presented, the programmed processing of the controller within a mother board interfaced to the componentry is now discussed with reference to the FIGS. 2-4.

Figure 2:
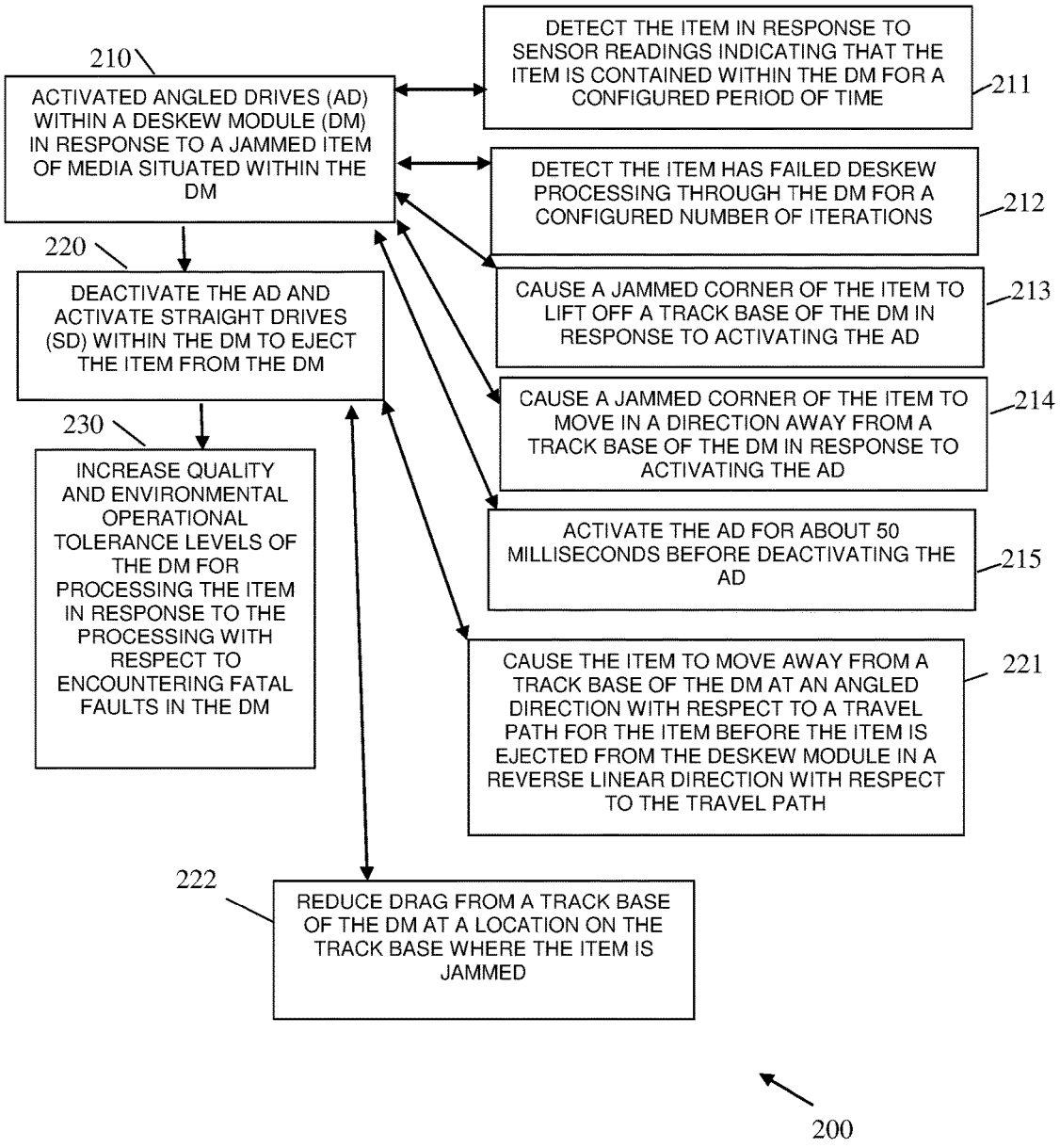
FIG. 2 is a diagram of a method for ejecting damaged/deformed media, according to an example embodiment.

FIG. 2 is a diagram of a method 200 for ejecting damaged/deformed media, according to an example embodiment. The method 200 when processed controls ejection processing for a deskew module integrated into a valuable media depository. The method 200 is implemented as executed instructions representing one or more software modules referred to as an ejection manager. The instructions reside in a non-transitory computer-readable medium and are executed by one or more processors of the valuable media depository.

In an embodiment, the ejection manager is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the ejection manager is the controller discussed above with the FIGS. 1B-1F.

At 210, ejection manager activates angled drives within a deskew module in response to a jammed item of media situated within the deskew module. In an embodiment, the angled drives are the angled drives 104C1-C3 situated in two independent cells 104F and 104G within deskew module 104.

According to an embodiment, at 211, the ejection manager detects the jammed item of media in response to sensor readings indicating that the item is contained within the deskew module for a configured period of time. In an embodiment, sensors 104B situated within two independent cells 104F and 104G provide the sensor readings to the ejection manager. Moreover, a sensor reading is an indication that a particular sensor is either covered or uncovered by the item within the deskew module.

In an embodiment, at 212, the ejection manager detects the jammed item of media has failed deskew processing through the deskew module for a configured number of iterations. That is, the ejection manager performs deskew processing against the time for a pre-set number of iterations after which if the sensor readings still indicate that the item of media is present within the deskew module, the ejection manager determines that a jam condition is present and the item is jammed within the deskew module.

In an embodiment, at 213, the ejection manager causes a jammed corner of the item to lift off a track base of the deskew module in response to activating the angled drives.

In any of the of the preceding embodiments, at 214, the ejection manager causes a jammed corner of the item to move in a direction away from a track base of the deskew module in response to activating the angled drives.

In an embodiment of 213 and 214, the effect of activating the angled drives before initiating the straight drives (220) causes the jammed corner of the item to free itself from the track base on which it is lodged.

In an embodiment, at 215, the ejection manager activates the angled drives for a short period of time, which is about or approximately 50 milliseconds, before the ejection manager deactivates the angled drives at 220.

At 220, the ejection manager deactivates the angled drives and, then, activates straight drives within the deskew module for ejecting the item from the deskew module. This ejection processing is done in a reverse direction from an original travel path of the item that was attempting to be processed through the deskew module. In an embodiment, the straight drives are the straight drives 104D-D3 situated in multiple cells 104F and 104G of the deskew module 104.

According to an embodiment, at 221, the ejection manager causes the item to move away from a tack base of the deskew module at an angled direction with respect to an original travel path for the item before the item is ejected from the deskew module in a reverse linear direction with respect to the travel path.

In an embodiment, at 222, the ejection manager reduces drag being experienced on a track base of the deskew module at a location on the track base where the item is jammed.

In an embodiment, at 230, the ejection manager processing provides an increase in quality and environmental operational tolerance levels for the deskew module when processing the item and thereby reduces the likelihood that the deskew module will experience fatal faults. That is, the ejection manager processing improves conventional ejection and jam processing, such that previous experienced faults for deskew modules are reduced because items with unacceptable degrees of damage or environmental conditions that were previously unfavorable can be successfully ejected with the ejection manager processing when conventionally without the ejection manager processing such damage or conditions would result in fatal faults of the deskew module.

Figure 3:
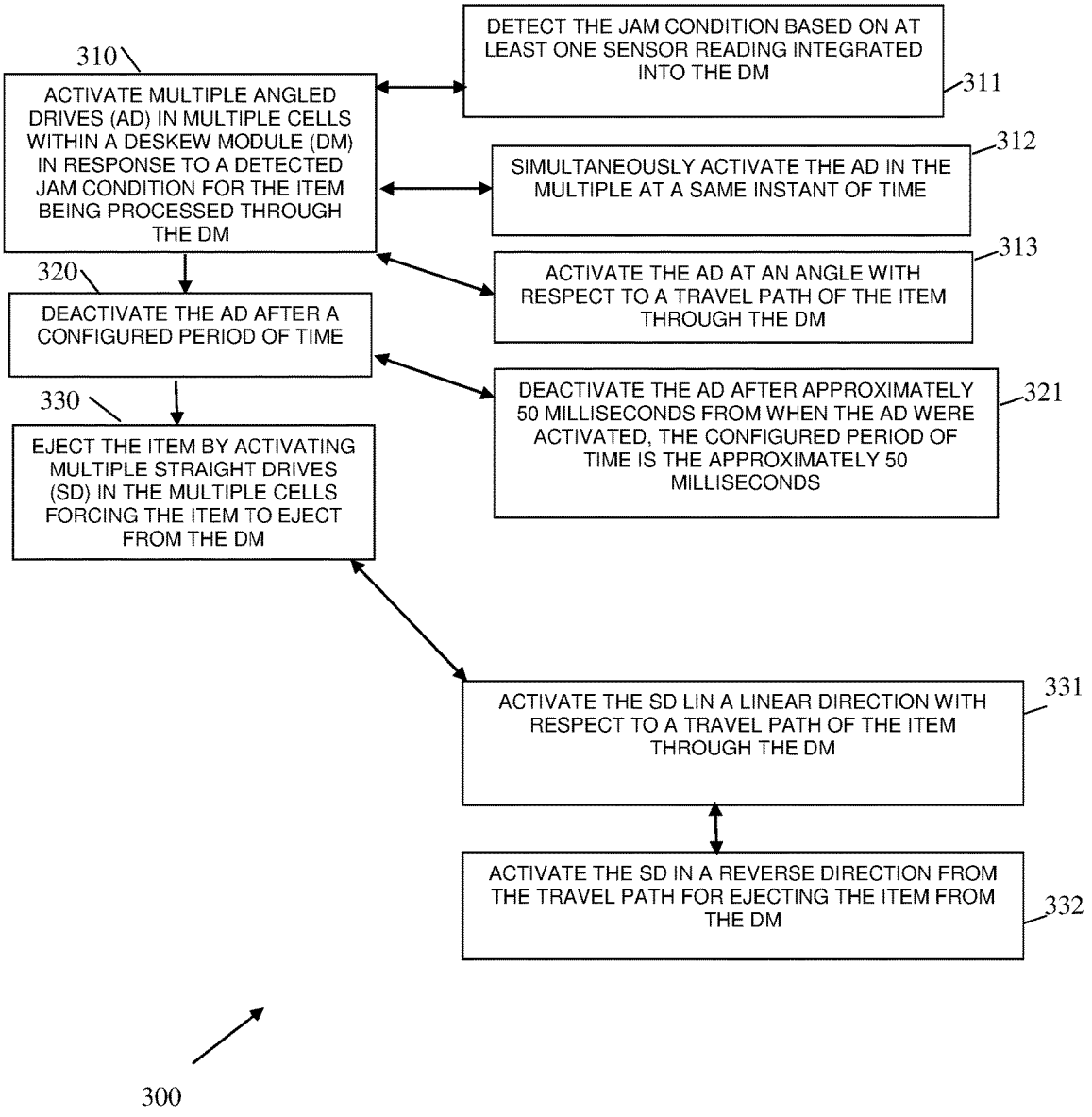
FIG. 3 is a diagram of another method for ejecting damaged/deformed media, according to an example embodiment.

FIG. 3 is a diagram of another method 300 for ejecting damaged/deformed media within a media depository, according to an example embodiment. The method 200 when processed controls ejection processing for a deskew module integrated into a valuable media depository. The method 200 is implemented as executed instructions representing one or more software modules referred to as a deskew controller. The instructions reside in a non-transitory computer-readable medium and are executed by one or more processors of the valuable media depository.

In an embodiment, the deskew controller is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the deskew controller is the controller and/or the ejection manager discussed above with the FIGS. 1B-1F and the FIG. 2.

In an embodiment, the deskew controller presents another and in some ways enhance perspective of the processing depicted in the method 200 (presented above with the discussion of the FIG. 2 and the ejection manager).

At 310, the deskew controller activates multiple angled drives in multiple cells within a deskew module in response to a detected jam condition for an item of media being processed through the deskew module. In an embodiment, the multiple angled drives are angled drives 104C1-C3 situated within multiple independent cells 104F and 104G within the deskew module 104.

According to an embodiment, at 311, the deskew controller detects the jam condition based on at least one sensor reading integrated into the deskew module. In an embodiment, the at least one sensor reading is obtained from one or more of the sensors 104B.

In an embodiment, at 312, the deskew controller simultaneously activates all of the multiple angled drives in the multiple cells of the deskew module at a same instant of time.

In an embodiment, at 313, the deskew controller activates the multiple angled drives at an angle with respect to an original travel path of the item through the deskew module.

At 320, the deskew controller deactivates the multiple angled drives after a configured period of time.

In an embodiment, at 321, the deskew controller deactivates the multiple angled drives after about or approximately 50 milliseconds from when the multiple angled drives were initially activated by the deskew controller. Here, the configured period of time is 50 milliseconds.

At 330, the deskew controller ejects the item by activating multiple straight drives in the multiple cells thereby forcing the item to eject from the deskew module. In an embodiment, the multiple straight drives are drives 104D1-D3 situated within multiple independent cells 104F and 104G of the deskew module 104. In an embodiment, the deskew controller simultaneously activates all the multiple straight drives in the multiple cells at a same instant of time.

According to an embodiment, at 331, the deskew controller activates the multiple straight drives in a linear direction with respect to an original travel path of the item thought the deskew module.

In an embodiment of 331 and at 332, the deskew controller activates the multiple straight drives in a reverse direction from the original travel path of the item for ejecting the time from the deskew module.

Figure 4:
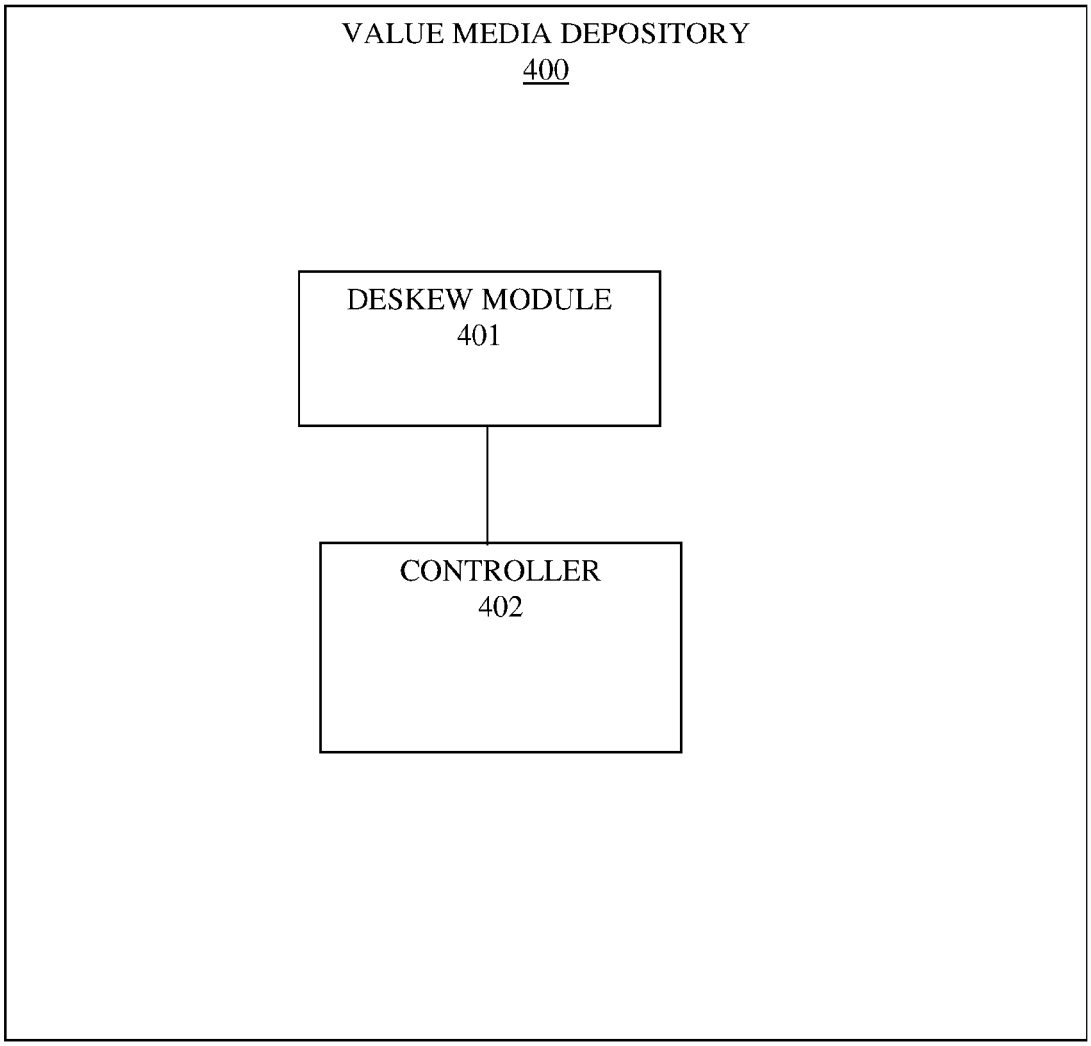
FIG. 4 is a media depository, according to an example embodiment.

FIG. 4 is a media depository 400 with a deskew module, according to an example embodiment. The valuable media depository 400 processes valuable media and includes a variety of mechanical, electrical, and software/firmware components, some of which were discussed above with reference to the FIGS. 1A-1H and the FIGS. 2-3.

In an embodiment, the valuable media depository 400 is a deposit module.

In an embodiment, the valuable media depository 400 is a recycler module.

In an embodiment, the valuable media depository 400 is the depository 100.

In an embodiment, the valuable media depository 400 is the depository that performs any of the methods 200 and 300 of the FIGS. 2-3.

In an embodiment, the valuable media depository 400 is a peripheral device integrated into an SST. In an embodiment, the SST is an ATM. In an embodiment, the SST is a kiosk.

In an embodiment, the valuable media depository 400 is a peripheral device integrated into a Point-Of-Sale (POS) terminal.

The valuable media depository 400 includes a deskew module 401 including a controller 402 operable to control the deskew module 401.

The deskew module 401 is configured to deskew items of media being processed through the depository 400.

In an embodiment, the deskew module 401 is the deskew module 104.

The controller 402 is configured to: i) activate a first type of mechanical component of the deskew module 401 when a particular item of media is jammed within the deskew module 401, and ii) activate a second type of mechanical component in a reverse direction to eject the particular item from the deskew module 401 after deactivation of the first type of mechanical component.

In an embodiment, the first type of mechanical component is an angled drive, such as angled drives 104C-C3. In an embodiment, the second type of mechanical component is a straight drive, such as straight drives 104D1-D3.

In an embodiment, the controller 402 is the controller discussed above with reference to the FIGS. 1A-1F.

In an embodiment, the controller 402 is the processing represented by the method 200.

In an embodiment, the controller 402 is the processing represented by the method 300.

In an embodiment, the controller 402 is the processing represented by all or some combination of: the controller 104, the method 200, and the method 300.

In an embodiment, the controller 402 is further configured to activate the first type of mechanical component for a configured period of time. In an embodiment, the configured period of time is approximately 50 milliseconds.

In an embodiment, the controller 402 drives the electromechanical components of the deskew module 104 as discussed in the FIGS. 1A-1F and the FIGS. 2-3.

In an embodiment, the controller 402 is installed as a firmware upgrade to an existing deskew module of an existing depository.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A depository, comprising:

a deskew module including a first drive roller and a second drive roller oriented at an angle with respect to the first drive roller, and a sensor adjacent the second drive roller; and a controller operable to control the deskew module;

wherein the deskew module is configured to deskew the items of media being processed through the depository and to free items of media jammed in a current position adjacent the sensor, and wherein the controller is configured upon receipt of a sensor signal from the sensor indicating that a particular item is in jammed in the current position to: (i) activate the second drive roller of the deskew module in a reverse direction of the second drive roller to move the particular item away from the current position , and (ii) activate the first drive roller in a reverse direction of the first drive roller to eject the particular item from the deskew module after deactivation of the second drive roller.

2. The depository of claim 1, wherein the controller is further configured, in (i), to: activate second drive roller for a predetermined period of time.

3. The depository of claim 1, wherein the first drive roller is oriented parallel to a transport path of the items of media.

4. The depository of claim 1, wherein the depository is one of: a deposit module and a recycler module.

* * * * *